US007232385B2

(12) United States Patent
David

(10) Patent No.: US 7,232,385 B2
(45) Date of Patent: Jun. 19, 2007

(54) HOCKEY STICK WITH ERGONOMIC SHAFT

(76) Inventor: Timothy L. David, 5294 E. Bald Eagle Blvd., White Bear Lake, MN (US) 55110

( * ) Notice: Subject to any disclaimer, the term of this patent is extended or adjusted under 35 U.S.C. 154(b) by 0 days.

(21) Appl. No.: 10/986,566

(22) Filed: Nov. 11, 2004

(65) Prior Publication Data

US 2006/0100043 A1 May 11, 2006

(51) Int. Cl.
*A63B 59/14* (2006.01)

(52) U.S. Cl. ..... 473/560

(58) Field of Classification Search ..... 473/560–563
See application file for complete search history.

(56) References Cited

U.S. PATENT DOCUMENTS

| | | | | |
|---|---|---|---|---|
| 1,201,728 | A | 10/1916 | Henry et al. | |
| 1,418,683 | A | 6/1922 | Stevens | |
| 1,561,349 | A | 11/1925 | Murphy et al. | |
| 1,616,377 | A | 2/1927 | Knight | |
| 3,080,900 | A | 3/1963 | Rosenberg | |
| 3,326,554 | A | 6/1967 | Scully | |
| 3,679,209 | A * | 7/1972 | Wexstaff | 273/129 R |
| 4,038,719 | A | 8/1977 | Bennett | |
| 4,351,528 | A | 9/1982 | Duplin | |
| 4,544,157 | A | 10/1985 | Curtis | |
| 4,553,753 | A | 11/1985 | Gibbons | |
| 4,629,190 | A * | 12/1986 | Borgen | 473/560 |
| 4,793,613 | A | 12/1988 | Hughes | |
| 4,799,682 | A | 1/1989 | Hughes | |
| 6,004,234 | A | 12/1999 | Majchrowicz | |
| 6,248,031 | B1 | 6/2001 | Brodie | |
| 6,267,697 | B1 | 7/2001 | Sulenta | |
| 6,364,792 | B1 | 4/2002 | Evanochko | |
| 6,500,079 | B1 | 12/2002 | Tucker, Sr. | |
| 2002/0066163 | A1 | 6/2002 | Lomax | |
| 2003/0045380 | A1 | 3/2003 | Tucker, Sr. | |

FOREIGN PATENT DOCUMENTS

| | | | |
|---|---|---|---|
| CA | 273438 | * | 8/1927 |
| CA | 001167876 A | * | 5/1984 |

* cited by examiner

*Primary Examiner*—Mark S. Graham
(74) *Attorney, Agent, or Firm*—Merchant & Gould P.C.

(57) ABSTRACT

The disclosure relates to a hockey stick comprising a shaft and a blade, the shaft including a top side, a bottom side, a front side, a back side, an upper end, a lower end, and a length extending between the upper end and the lower end, the shaft including a first straight section and a second section. The first section extends from the lower end of the shaft to the second section and the second section extends from the first section to the upper end of the shaft. The second section is disposed at an angle relative to the first section, the angle being defined generally along a plane extending from the top side of the shaft to the bottom side of the shaft, wherein the second section starts at about ½ to about ⅘ of the length of the shaft from the lower end of the shaft.

19 Claims, 3 Drawing Sheets

HOCKEY STICK WITH ERGONOMIC SHAFT

TECHNICAL FIELD

The principles disclosed herein relate generally to a hockey stick with an ergonomic shaft.

BACKGROUND

Hockey is a popular sport played by many from young children to professional athletes. Hockey sticks have an overall shape which has changed very little since the game was first played. A conventional hockey stick includes a blade mounted to the lower end of an elongated, straight shaft. A grip is usually-formed at the upper end of the shaft, which is typically provided by wrapping the upper end of the shaft with tape. Players may hold the shaft by the grip with one hand, but usually grasp the shaft with both hands, one hand grasping the grip which can be referred to as the dominant control hand and the other hand grasping the shaft further down from the grip. Passing and shooting the puck usually requires holding the stick with both hands.

Although the overall shape of a hockey stick has changed very little over time, the materials from which the sticks are made tend to vary considerably. The blade portion of the stick is usually formed of wood and may be reinforced with a fiber and epoxy matrix. The blade is also sometimes formed from a plastic material. The shaft portion is also usually formed of wood and may also be reinforced with a fiber and epoxy material. Alternative materials to wood such as carbon fiber materials, certain metals including aluminum, or composite materials offering a variety of shaft stiffness and weight are becoming popular among many players. The shaft may be formed as a solid piece or be formed as a hollow tubular structure. The hockey stick is typically provided as an integral unit, with the blade either integrally formed with the shaft or otherwise permanently fastened to the shaft.

Accurately passing or shooting the puck with the stick requires a great deal of skill. Therefore, it is important for the player's hockey stick to enhance the player's skill or at least not unduly interfere or impede the player's ability. A player can select a stick from a variety of sticks offering a range of shaft stiffness, blade curvature, blade to shaft angles, etc.

Although the variety of materials from which hockey sticks are made have provided players with choices to enhance their skill level, there has been very little improvement to the overall shape of the hockey stick shaft. What is needed is an improved hockey stick shaft that provides a more natural/ergonomically correct alignment between the forearm and the hand while keeping the blade of the stick in the correct alignment on the ice for optimal control of the puck. What is needed is a shaft design that allows the muscles in the forearm (which drive the controlling hand), the muscles in the wrist, and the muscles in the hand to function in a more ergonomically correct manner to increase strength, control and mobility of the controlling hand on the stick during shooting, passing, and stick handling.

SUMMARY

The present disclosure describes embodiments relating to a hockey stick with an improved shaft that provides a more natural/ergonomically correct alignment between the gripping hand and the forearm to provide for increased strength, control and mobility.

According to one inventive aspect of the disclosure, a shaft with a gently sweeping curve that allows both hands to move up and down the stick without disruption, that does not detract/deviate from the dominant line of the shaft, and that avoids a drastic angle which could cause a hooking danger to other players is provided.

According to another inventive aspect of the disclosure, a hockey stick comprising a shaft and a blade, the shaft including an upper end, a lower end, and a length extending between the upper end and the lower end, the shaft including a first straight section and a second section angled to the first section, is provided. The first section extends from the lower end of the shaft to the second section and the second section extends from the first section to the upper end of the shaft. The angle of the second section relative to the first section is defined generally along a plane extending from the top side of the shaft to the bottom side of the shaft, wherein the second section starts at about ½ to about ⅘ of the length of the shaft from the lower end of the shaft.

According to a further inventive aspect of the disclosure, the first straight section of the shaft may define an axis, the second section being angled downwardly from the axis defined by the first section.

According to yet a further inventive aspect of the disclosure, the second section of the shaft may include a continuous curve extending from the upper end of the shaft, the curve being generally along a plane extending from the top side of the shaft to the bottom side of the shaft, the continuous curve defining at least about ⅕ of the length of the shaft.

A variety of additional inventive aspects will be set forth in the description that follows. The inventive aspects can relate to individual features or combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the specification, illustrate various embodiments that are examples of how certain inventions can be put into practice. A brief description of the drawings is as follows.

DETAILED DESCRIPTION

Figure 1:
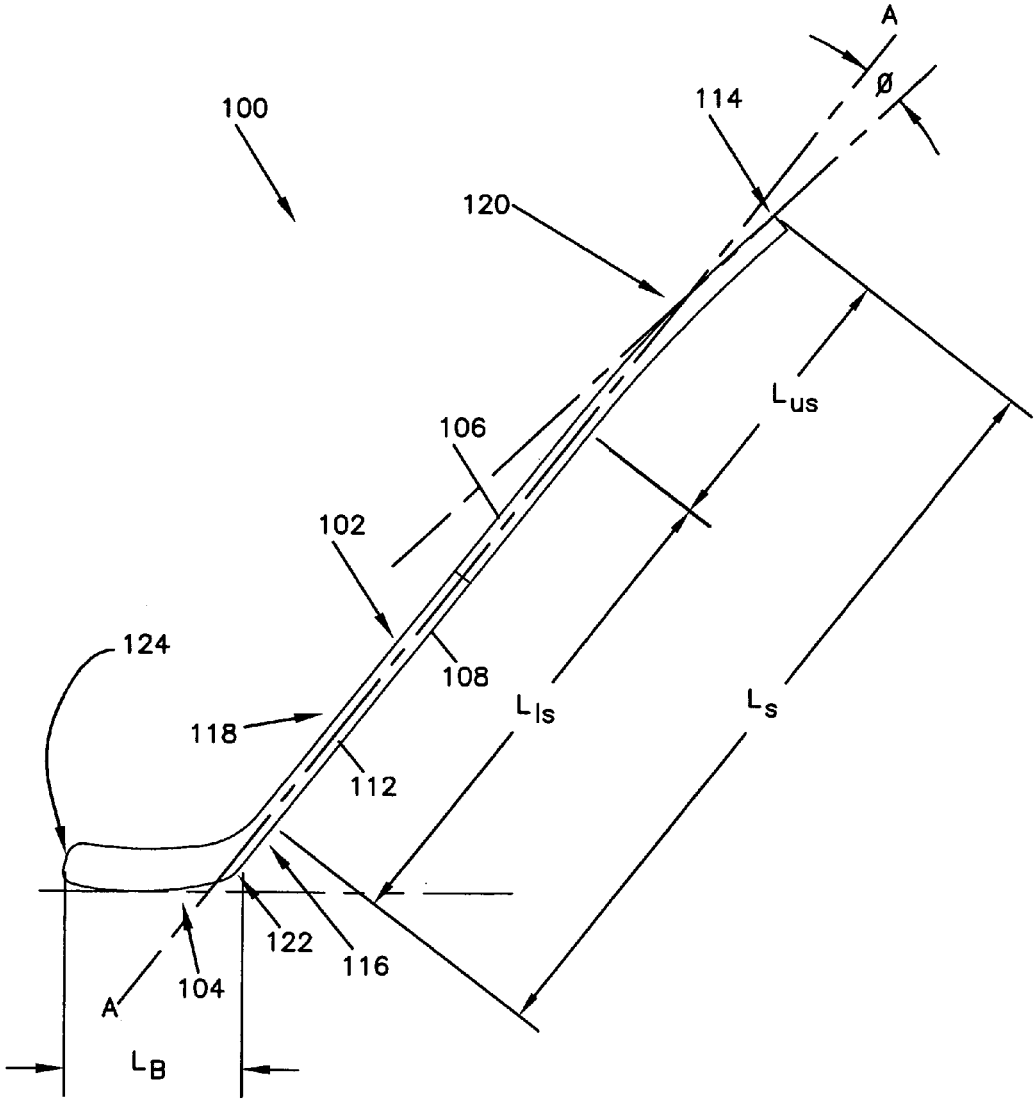
FIG. 1 is a back side view of a hockey stick having features that are examples of inventive aspects in accordance with the present disclosure.
Figure 2:
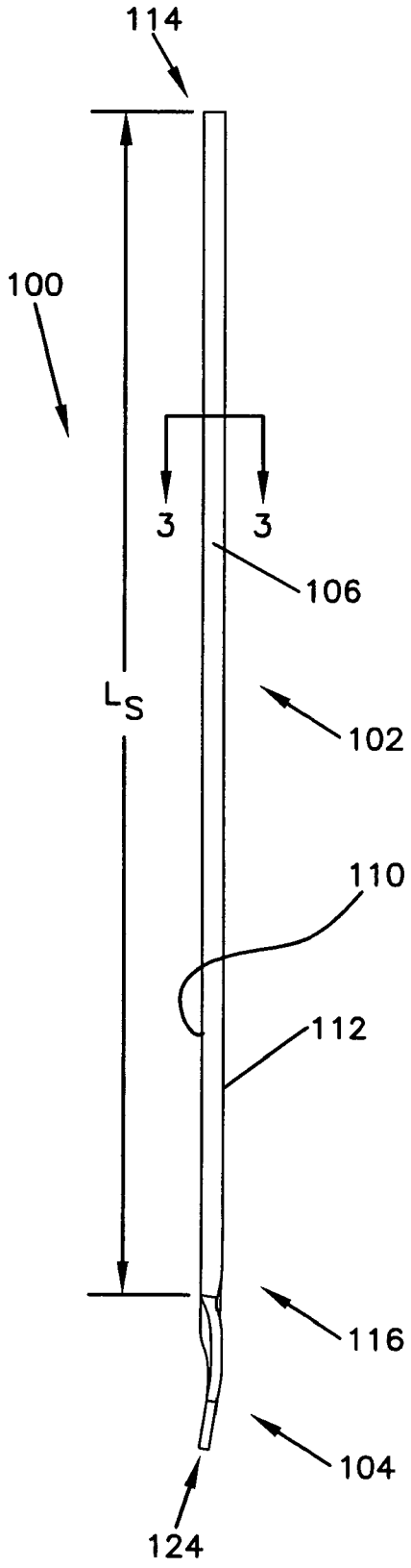
FIG. 2 is a top view of the hockey stick of FIG. 1.
Figure 3:
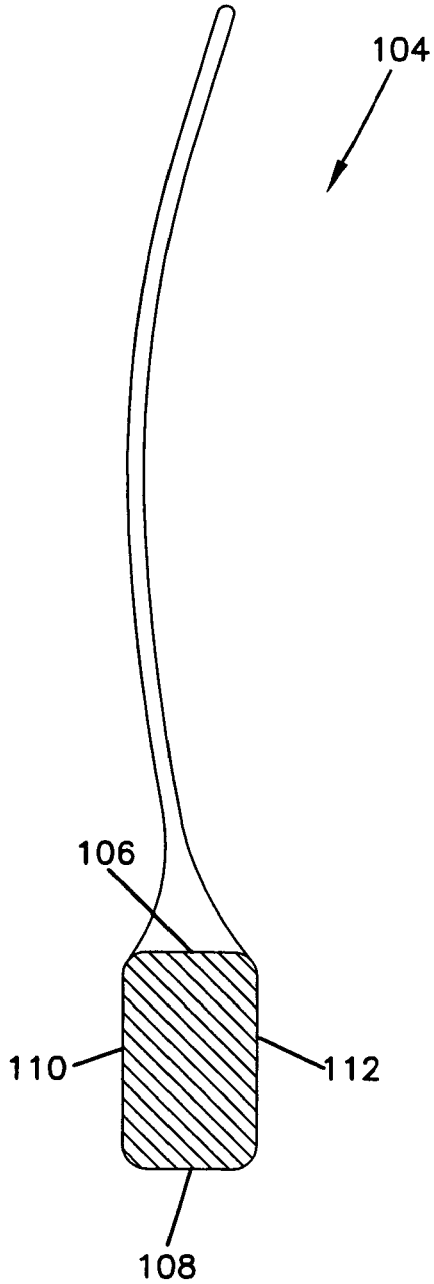
FIG. 3 is a cross sectional view of the hockey stick of FIG. 1, taken along line 3—3 of FIG. 2.

FIGS. 1–3 illustrate a hockey stick 100 having features that are examples of how various inventive concepts disclosed herein can be practiced.

Referring to FIG. 1, the hockey stick 100 includes a shaft portion 102 and a blade portion 104 extending from the shaft portion 102. In certain embodiments, the blade 104 and the shaft 102 may be provided as separate pieces coupled together. In other embodiments, the blade 104 and the shaft may be formed as a single unitary piece.

The shaft 102 includes a top side 106, a bottom side 108, a front side 110, and a back side 112, as shown in FIGS. 1 and 3. It should be understood that the directional orientation of the hockey stick has been determined according to a stick held by a player in the forehand shooting position. As such, the front side of the shaft is designated as the side toward which the blade portion of the hockey stick curves or the "forehand" side of the blade.

The shaft 102 defines an upper end 114, a lower end 116, and a length $L_S$ extending between the upper end 114 and the lower end 116. The upper end 114 may be wrapped with tape and used as a grip portion for the stick. The shaft 102 includes a lower section 118 and an upper section 120, the upper section 120 being disposed at an angle θ relative to the lower section 118. In some embodiments, the lower section 118 may be provided as a straight section and the upper section 120 may be provided as a curved section, including a continuous curve that extends from the lower section 118 to the upper end 114 of the shaft 102, as depicted in FIG. 1.

The angle θ is generally defined along a plane extending from the top side 106 of the shaft 102 to the bottom side 108 of the shaft 102. In some embodiments, the straight lower section 118 may define an axis A—A and the upper section 120 may be angled downwardly from the axis A—A defined by the lower section 118, as illustrated in the embodiment of FIG. 1. It will be understood that the downward direction may also be referred to as the direction generally opposite of the direction the blade 104 extends out from the shaft 102. A downward curve such as the one depicted in FIG. 1 allows the controlling arm of a hockey player to be extended in a more natural/ergonomic position and helps keep the bottom edge of the blade flat against the ice for increased strength, control, and mobility.

Figure 4:
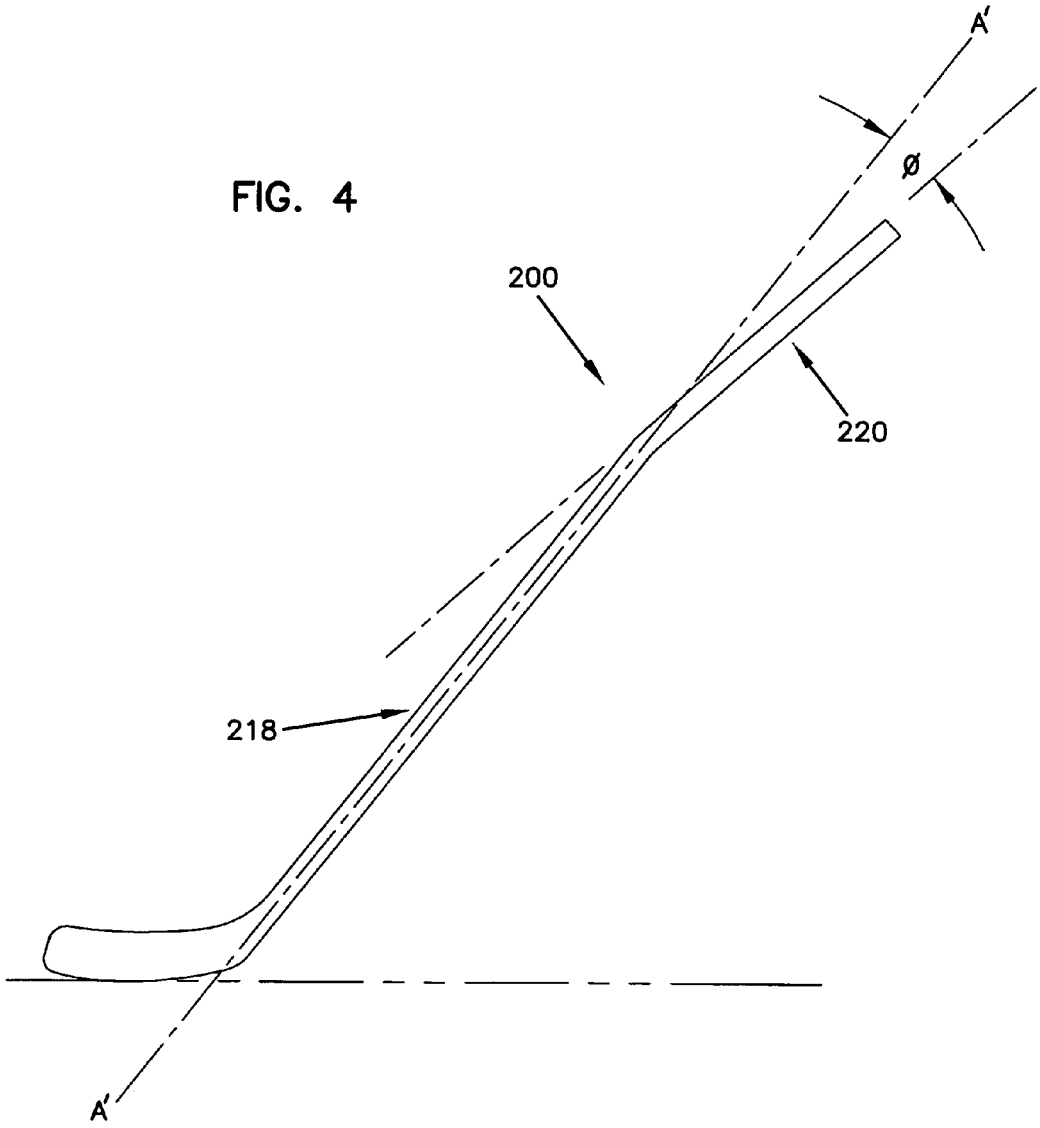
FIG. 4 is a back side view of another embodiment of a hockey stick having features that are examples of inventive aspects in accordance with the present disclosure.

In certain embodiments, the angle θ may be less than about 30 degrees. In certain other embodiments, the angle θ may be between about 5 and 25 degrees. In certain other embodiments, the angle θ may be between about 10 and 20 degrees. In certain preferred embodiments, the angle θ may be less than about 15 degrees. A gentle, sweeping curve such as the one depicted in the embodiment of FIG. 1 allows both hands of a player to move up and down the stick without disruption, especially the dominant controlling hand. Although a continuous curved upper section 120 as depicted in FIG. 1 may be preferable, a straight upper section 220 disposed at an angle θ to an axis A'—A' of the lower section 218 (as shown in FIG. 4) may also be used.

It will be understood that for a curved portion of the shaft 102, the angle θ may be determined by taking a tangent line of any point along the curved portion relative to another section. Otherwise, if a portion of a section of the shaft is generally a straight portion, then the angle θ between the two portions may be determined conventionally. For example, in the embodiment of the hockey stick 100 illustrated in FIGS. 1–3, the angle θ may vary depending where on the curved portion it is taken. For illustrative purposes, in FIG. 1, the tangent line is taken at a point on the curve where the control hand of a player may be located.

Still referring to FIG. 1, the upper section 120 preferably starts at about ½ to about ⅘ of the length $L_S$ of the shaft 102 from the lower end 116 of the shaft 102. More preferably, the upper section 120 starts at about 9/16 to about ¾ of the length $L_S$ of the shaft 102 from the lower end 116 of the shaft 102. Most preferably, the upper section 120 starts at about ⅗ to about 7/10 of the length $L_S$ of the shaft 102 from the lower end 116 of the shaft 102.

As shown in FIG. 1, the lower section 118 of the shaft 102 includes a length $L_{ls}$ and the upper section 120 of the shaft 102 includes a length $L_{us}$. In certain embodiments, the upper section 120 may define a continuous curve extending to the upper end 114 of the shaft 102 that defines a length $L_{us}$ that is at least about ⅕ of the length $L_S$ of the shaft 102. In other embodiments, the upper section 120 may define a continuous curve that defines a length $L_{us}$ that is at least about ¼ of the length $L_S$ of the shaft 102.

For adult sticks, the upper section, 120 (FIG. 1), 220 (FIG. 4), of the stick can have a length $L_{us}$ of at least 18 inches. For children sticks or in other embodiments, the length may be shorter.

It will be understood that the given dimensions are for exemplary purposes only and that there will certainly be variations in the dimensions of different kinds of sticks in the art.

The two sections, 118 and 120, of the shaft 102 may be formed as two separate pieces and coupled together or may be formed from a single unitary piece, as mentioned above for the blade. The shaft 102 may be manufactured out of wood (and reinforced with a fiber and epoxy matrix), metals such as aluminum, composites, or other materials known in the art.

The blade portion 104 of the stick 100 extends from the lower section 118 of the shaft 102 adjacent the lower end 116 of the shaft. The blade 104 includes a heel 122, a toe 124, and a length $L_B$ extending between the heel and the toe. The blade 104 is generally curved, the curve defining the front side 110 of the shaft 102 as mentioned above. The blade may be manufactured out of wood and reinforced with a fiber and epoxy matrix or manufactured out of other materials known in the art.

Referring to FIG. 4, a back side view of a hockey stick 200 having features that are examples of inventive aspects in accordance with the present disclosure is illustrated. The embodiment of the hockey stick 200 is generally similar to the embodiment 100 illustrated in FIGS. 1–3, except that, as discussed above, hockey stick 200 includes two straight sections, a lower straight section 218 and an upper straight section 220, disposed at angle θ to each other.

It will be understood that, although the hockey sticks 100 and 200 depicted are for left handed players, a left handed hockey stick is shown for illustration purposes only and the inventive aspects of the disclosure are equally applicable to right handed sticks and also for sticks with straight blades rather than curved blades.

It will be appreciated that, although the inventive aspects of the disclosure has been described with respect to hockey sticks in general, the inventive aspects of the disclosure can be practiced in other "stick" sports including broom ball, lacrosse, golf, etc.

Many embodiments of the invention can be made without departing from the spirit and scope of the invention, and the broad scopes of the invention are not intended to be limited by the specific embodiments depicted and described herein.

The invention claimed is:

1. A hockey stick comprising:

a shaft including a top side, a bottom side, a front side, a back side, an upper end, a lower end, and a length extending between the upper end and the lower end, the shaft including a first straight section and a second section, the first section extending from the lower end of the shaft to the second section and the second section extending from the first section to the upper end of the shaft, the second section being disposed at an angle relative to the first section, the angle being defined generally along a plane extending from the top side of the shaft to the bottom side of the shaft, the second section starting at about 9/16 to about 3/4 of the length of the shaft from the lower end of the shaft; and a blade extending from the first section of the shaft adjacent the lower end, wherein the second section defines a continuous curve extending from the first section to the upper end of the shaft.

2. A hockey stick according to claim 1, wherein the blade extends in a first direction and the second section is angled away from the first section in a second direction, the second direction being generally opposite the first direction.

3. A hockey stick according to claim 1, wherein the second section starts at about 3/5 to about 7/10 of the length of the shaft from the lower end of the shaft.

4. A hockey stick according to claim 1, wherein the second section is disposed at an angle of less than about 30 degrees relative to the first section.

5. A hockey stick according to claim 4, wherein the second section is disposed at an angle of less than about 15 degrees relative to the first section.

6. A hockey stick according to claim 4, wherein the second section is disposed at an angle between about 5 and 25 degrees relative to the first section.

7. A hockey stick according to claim 6, wherein the second section is disposed at an angle between about 10 and 20 degrees relative to the first section.

8. A hockey stick according to claim 1, wherein the second section of the shaft is at least 18 inches in length.

9. A hockey stick comprising:

a shaft including an upper end, a lower end, and a length extending between the upper end and the lower end, the shaft including a first straight section defining an axis and a second section including a continuous curve that curves downwardly from the axis, the curve extending from the first section to the upper end of the shaft and the second section being disposed at an angle relative to the first section, the second section non-pivotally fixed to the first section, the first section extending from the lower end of the shaft to the second section and the second section extending from the first section to the upper end of the shaft, the second section being angled downwardly from the axis defined by the first section at an angle of about 5 to 25 degrees, the angle measured at an uppermost end of the shaft, the second section starting at about 9/16 to about 3/4 of the length of the shaft from the lower end of the shaft; and a blade extending from the first section of the shaft adjacent the lower end.

10. A hockey stick according to claim 9, wherein the second section starts at about 3/5 to about 7/10 of the length of the shaft from the lower end of the shaft.

11. A hockey stick according to claim 9, wherein the second section is angled downwardly from the axis about 10 to 20 degrees.

12. A hockey stick according to claim 9, wherein the second section is angled downwardly from the axis less than about 15 degrees.

13. A hockey stick according to claim 9, wherein the second section of the shaft is at least 18 inches in length.

14. A hockey stick comprising:

a shaft including a top side, a bottom side, a front side, a back side, an upper end, a lower end, and a length extending between the upper end and the lower end, the shaft including a continuous curve extending between the upper end and the lower end of the shaft, the curve being generally along a first plane extending from the top side of the shaft to the bottom side of the shaft, the continuous curve defining at least about 1/5 of the length of the shaft; and a blade extending from the lower end of the shaft, the blade including an upper blade edge and a lower blade edge, the upper blade edge and the lower blade edge defining a second plane thereinbetween, the continuous curve of the shaft extending substantially along the second plane defined between the upper and lower edges of the blade.

15. A hockey stick according to claim 14, wherein the continuous curve defines at least about 1/4 of the length of the shaft.

16. A hockey stick according to claim 14, wherein the shaft includes a first section and a second section, the first section extending from the lower end of the shaft to the second section and the second section extending from the first section to the upper end of the shaft, the second section being disposed at an angle of about 5 to 25 degrees relative to the first section, the angle being defined generally along a plane extending from the top side of the shaft to the bottom side of the shaft, the angle measured at an uppermost end of the shaft.

17. A hockey stick according to claim 14, wherein the shaft includes a first section and a second section, the first section extending from the lower end of the shaft to the second section and the second section extending from the first section to the upper end of the shaft, the second section being disposed at an angle of less than about 15 degrees relative to the first section, the angle being defined generally along a plane extending from the top side of the shaft to the bottom side of the shaft, the angle measured at an uppermost end of the shaft.

18. A hockey stick according to claim 14, wherein the continuous curve is at least 18 inches in length.

19. A hockey stick comprising:

a shaft including an upper end, a lower end, and a length extending between the upper end and the lower end, the shaft including a first straight section defining an axis and a second section disposed at an angle relative to the first section, the second section non-pivotally fixed to the first section, the first section extending from the lower end of the shaft to the second section and the second section extending from the first section to the upper end of the shaft, the second section being angled downwardly from the axis defined by the first section at an angle of about 5 to 25 degrees, the angle measured at an uppermost end of the shaft, the second section starting at about 9/16 to about 3/4 of the length of the shaft from the lower end of the shaft; and a blade extending from the first section of the shaft adjacent the lower end, wherein the second section defines a continuous curve that curves downwardly from the axis, the curve extending from the first section to the upper end of the shaft.

* * * * *